United States Patent [19]

Putt

[11] Patent Number: 4,877,371

[45] Date of Patent: Oct. 31, 1989

[54] PUMP

[75] Inventor: Francis G. Putt, Brighton, Mich.

[73] Assignee: Kerr Machinery Corporation, Oak Park, Mich.

[21] Appl. No.: 234,588

[22] Filed: Aug. 22, 1988

[51] Int. Cl.[4] ..... F04D 29/62

[52] U.S. Cl. ..... 415/169.1; 415/201; 415/214.1

[58] Field of Search ..... 415/109 R, 170 A, 199.2, 415/199.3, 201, 219 R, 219 C, 501; 417/423.11, 423.12, 423.14, 424.1

[56] References Cited

U.S. PATENT DOCUMENTS

| | | | |
|---|---|---|---|
| 2,435,470 | 2/1948 | Samelson | 417/423.11 X |
| 2,445,182 | 7/1948 | Odey | 417/423.15 X |
| 2,693,760 | 11/1954 | Miller | 415/201 X |
| 2,839,006 | 6/1958 | Mayo | 415/169 R |
| 2,978,988 | 4/1961 | McAlpine | 417/423.14 X |
| 3,463,088 | 8/1969 | Umbricht | 415/169 R |

FOREIGN PATENT DOCUMENTS

| | | | |
|---|---|---|---|
| 1653663 | 8/1971 | Fed. Rep. of Germany | 415/219 C |
| 478747 | 3/1953 | Italy | 415/169 R |
| 895914 | 5/1962 | United Kingdom | 415/501 |
| 2071764 | 9/1981 | United Kingdom | 415/201 |

*Primary Examiner*—Robert E. Garrett
*Assistant Examiner*—Joseph M. Pitko
*Attorney, Agent, or Firm*—Lyman R. Lyon

[57] ABSTRACT

A vertical turbine pump comprises an assembly including a rotatable pump shaft, an impeller, and an impeller bowl. The assembly is removably mounted in a fluid flow diverter that directs fluid at a right angle to the axis of rotation of the pump shaft then to a path parallel to the axis of rotation of the pump shaft.

1 Claim, 1 Drawing Sheet

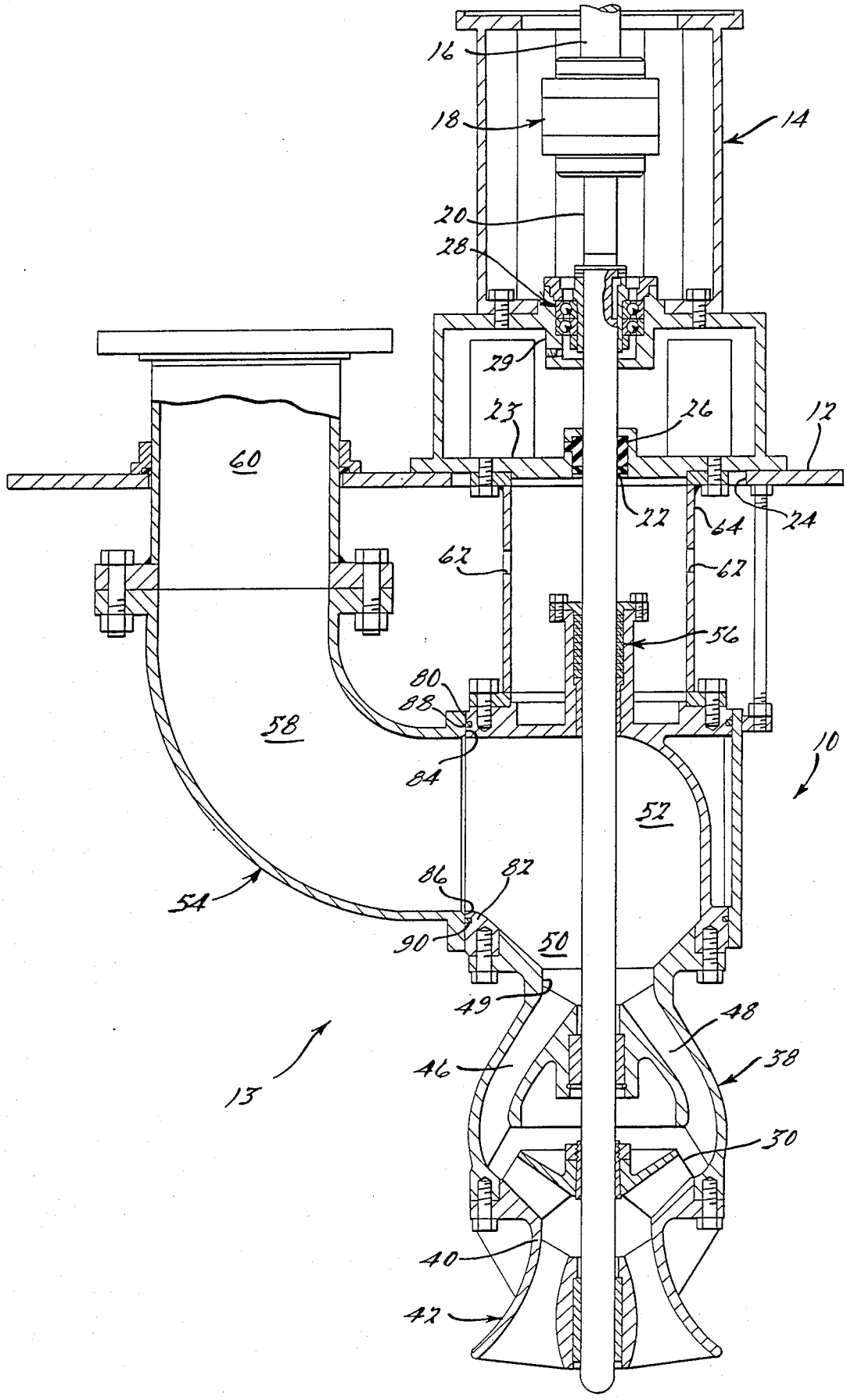
16
18
14
20
28
29
23
26
12
60
22
64
24
62
62
56
80
88
58
84
10
52
86
82
54
90
50
49
48
46
38
13
30
40
42

PUMP

BACKGROUND OF THE INVENTION

The instant invention relates generally to pumps and, more specificaly, to a vertically orientated turbine pump, and is an improvement on the pump disclosed in my co-pending application Ser. No. 234,589 filed Aug. 22, 1988 entitled "PUMP".

Turbine pumps are often used to move dirty, corrosive or hazardous liquids in, for example, air washers, filtration systems, paint systems, or other chemical systems. Such pumps are taught in, for example, Gschwender Patent No. 4,530,641, which discloses a vertical turbine pump having a pump shaft that is surrounded by lifting ducts which transport the liquid out of the tank. The bearings of Gschwender are lubricated by the liquid being pumped which is then drained back into the tank through clearance gaps in the lifting ducts surrounding the pump shaft. However, if the liquid being pumped contains particulate matter, the bearings may not be properly lubricated. Furthermore, if the liquid is corrosive, the bearings face direct exposure thereto.

U.S. Pat. No. 3,897,176, issued on July 29, 1975, to Emeny discloses a pump having an apertured protective tube surrounding the pump shaft. Liquid flows up the gap between the pump shaft and the protective tube and flows out the apertures of the tube and back down to the impeller area to insure continuous flow. Unfortunately, liquid containing particulate matter may clog the apertures, causing pressurized liquid to flow up the gap and into the shaft bearings.

Modianos U.S. Pat. No. 4,063,849, discloses a vertical turbine pump having a stuffing box subjected to high pressure liquid.

U.S. Pat. Nos. 4,695,222 and 3,478,690 issued on Sept. 22, 1987 and on Nov. 18, 1969, to Barraza and Helke, respectively, disclose selfcontained sewage systems having a pump shaft, a discharge shaft for transport of a liquid, and a protective seal subjected to pressurized liquid. However, neither can be used reliably in applications involving dirty or corrosive liquids because both systems use shaft bearings which may clog or deteriorate if the protective seal leaks during operation.

SUMMARY OF THE INVENTION

The object of the instant invention is a turbine pump capable of pumping dirty, viscous, hazardous, or corrosive liquids from a tank to another location without the potential of damaging either the surrounding environment or the shaft bearings of the pump due to failure of the shaft seals and that is capable of quick and easy removal from the tank for service or replacement.

The turbine pump of the instant invention comprises a vertically orientated pump shaft having a plurality of impellers thereon for the pumping of liquids from a tank. The pump impellers transport liquid into a flow diverter of novel configuration through which the pump shaft passes. The flow diverter is configured to reduce fluid velocity and pressure therein minimizing leakage of pressurized liquid through the shaft seals. The flow diverter is sectioned in a manner that permits easy removal of the entire pump and prime mover thereof.

The flow diverter communicates with a truncated conical pressure and velocity reducing section on an upper impeller bowl. The diverter comprises a 90° elbow section that is entirely removable from a second 90° elbow section. A shaft seal is disposed opposite the pressure reducing section of the impeller bowl and is removable therewith.

BRIEF DESCRIPTION OF THE DRAWINGS

FIG. 1 is a sectional view of the pump of the instant invention.

DETAILED DESCRIPTION OF THE PREFERRED EMBODIMENT OF THE INVENTION

Referring to the drawing, a preferred embodiment of a vertical turbine pump 10 in accordance with the instant invention is supported by a top cover plate 12 of a tank 13. A pump motor (not shown) is mounted above the tank 13 by a motor support bracket 14 which, in turn, is supported by the tank cover plate 12. A motor shaft 16, extends from the motor into engagement with a shaft coupling 18 which, in turn, is coupled to a pump shaft 20. The shaft 20 extends downwardly through an aperture 22 in a bottom plate 23 of the motor bracket 14. The bottom plate 23 of the motor bracket 14 closes a relatively large aperture 24 in the tank top 12 and supports a vapor seal 26 that is disposed about the pump shaft 20. The seal 26 prevents tank vapor from leaking outwardly from the tank 13.

The coupling 18 and pump shaft 20 are maintained in proper alignment with the motor shaft 16 by a bearing 28 which is retained in a bearing housing 30 in the motor bracket 14. It is to be noted that the bearing 28 is located above the shaft seal 26 and is surrounded by air at ambient pressure.

The pump shaft 20 extends downwardly for the support and drive of a pump impeller 36 which is disposed in an impeller bowl 38. A radially inwardly convergent upper end portion 40 of a suction bowl 42 communicates with the impeller 30. An upper end portion 44 of the impeller bowl 38 is provided with vanes 46 and 48, respectively, that extend axially upwardly and radially inwardly from the discharge end of the impeller 30 to define a relatively small diameter throat 49 and communicate with a radially outwardly and upwardly divergent pressure reducing section 50 of the impeller bowl 38. Liquid emerging from the vanes 46 and 48 of the impeller bowl 38 enters into the frusto conical, upwardly divergent discharge pressure reduction section 50 of the impeller bowl 38. The pressure reduction section 50 of the bowl 38 communicates with a 90° elbow portion 52 of a flow diverter 54. The flow diverter 54 functions to transport liquid laterally away from the shaft 20 and a fluid seal 56 to a 90° elbow section 58 thereof, thence to a discharge pipe 60.

The aforesaid geometry minimizes exposure of the pump shaft seal 56 to high pressure, high velocity liquid. Also, pressurized liquid is prevented from contacting the tank vapor shaft seal 26 by lateral openings 62 in a downwardly depending pump support sleeve 64 on the motor bracket 14. Thus, the vapor seal 26 in the bottom plate 23 of the motor bracket 14 is exposed only to tank vapor at atmospheric pressure and not pressurized liquids. Moreover, since any leakage through the shaft seal 56 flows back to the tank 13 through the apertures 62, the bearing 28 is protected from contamination and corrosion, eliminating the need for corrosive resistant materials therefor.

In accordance with the instant invention, the elbow section 52 of the flow diverter 54 has circular flanges 80 and 82 thereon for acceptance within complementary circular openings 84 and 86, respectively, in the diverter 54. A pair of O-rings 88 and 90 effect a seal between the flanges 80 and 82 and the openings 84 and 86, respectively. Thus, the entire pump 10 can be withdrawn vertically from the tank 13 and discharge piping elements 54 and 60 through the aperture 24 in the top plate 12 of the tank 13.

While the preferred embodiment of the invention has been disclosed, it should be appreciated that the invention is susceptible of modification without departing from the scope of the following claims.

I claim:

1. A vertical turbine pump for transferring liquid from a tank having a top panel with an aperture therein, said pump comprising a motor bracket secured to the top panel of said tank;

a rotatable pump shaft extending downwardly through said motor bracket and through the aperture in the top panel of said tank;

an impeller on said pump shaft;

an impeller bowl surrounding said impeller and having a discharge throat of relatively smaller diameter than said impeller and a truncated conical upwardly divergent fluid pressure reducing chamber above the discharge throat thereof;

a fluid flow diverter having a first 90° elbow portion communicating with the pressure reducing chamber of said impeller bowl for directing fluid flow at a right angle to the axis of rotation of said pump shaft, the first 90° elbow portion of said diverter having circular upper and lower flanges removably and sealably acceptable in complementary circular apertures in said diverter, a second 90° elbow portion of said diverter communicating with the first elbow portion for directing fluid flow to a path parallel to the axis of rotation of said pump shaft;

a shaft seal in the first 90° elbow of said flow diverter on an opposite wall thereof from the pressure reducing section of said impeller bowl, said shaft and one side of said shaft seal being exposed to fluid pressure internally of said flow diverter and the other side of said shaft seal being in fluid flow communication with the inside of said tank and exposed to internal tank pressure; and a vapor seal in the cover plate of said tank and disposed about said shaft, said vapor seal being disposed in axially spaced relation to said shaft seal, whereby said shaft between said shaft and said vapor seal is exposed to internal tank pressure and fluid leakage past said shaft seal is vented back to tank; said motor bracket, pump shaft, vapor seal, shaft seal, first diverter section, suction bowl, impeller bowl and impeller being vertically removable as an assembly through the aperture in the top panel of said tank.

* * * * *